US012637281B2

(12) United States Patent
Cloete

(10) Patent No.: US 12,637,281 B2
(45) Date of Patent: May 26, 2026

(54) CONTAINER WITH BOTH DISPENSATION AND FILL DEDICATED VALVED TUBE ASSEMBLIES

(71) Applicant: Kinnar Agriscience, Inc., Lawrenceville, GA (US)

(72) Inventor: Samuel L. Cloete, Suwanee, GA (US)

(73) Assignee: Kannar Agriscience, Inc., Lawrenceville, GA (US)

( * ) Notice: Subject to any disclaimer, the term of this patent is extended or adjusted under 35 U.S.C. 154(b) by 920 days.

(21) Appl. No.: 17/742,207

(22) Filed: May 11, 2022

(65) Prior Publication Data

US 2022/0380115 A1 Dec. 1, 2022

Related U.S. Application Data

(60) Provisional application No. 63/194,490, filed on May 28, 2021.

(51) Int. Cl.
*B65D 83/32* (2006.01)
*B65D 83/38* (2006.01)
*B65D 83/44* (2006.01)

(52) U.S. Cl.
CPC ..... *B65D 83/38* (2013.01); *B65D 83/32* (2013.01); *B65D 83/44* (2013.01); *B65D 2231/008* (2013.01)

(58) Field of Classification Search
CPC ..... B67D 1/0802; B65D 83/32
USPC ..... 220/601
See application file for complete search history.

(56) References Cited

U.S. PATENT DOCUMENTS 70,414 A * 11/1867 Cook ..... B65D 25/16 222/401
2,023,837 A * 12/1935 Heins ..... B67D 1/0802 222/400.7
2,253,940 A * 8/1941 Peet ..... F25D 17/02 165/142
3,129,730 A 4/1964 Simon
3,159,306 A * 12/1964 Lyall ..... E03B 11/00 220/601

(Continued)

FOREIGN PATENT DOCUMENTS

WO 1998042586 A1 10/1998

OTHER PUBLICATIONS

ISA/US; International Search Report and Written Opinion for International Patent Application No. PCT/US22/28829 dated Aug. 16, 2022, 8 pages.

*Primary Examiner* — David L Sorkin
(74) *Attorney, Agent, or Firm* — NK Patent Law

(57) ABSTRACT

A container includes: a first tube assembly for dispensation of liquid from the container; and a second tube assembly for filling the container. A base of the container has a sloped floor with a collection point defining the lowest point in the interior of the container. The first tube assembly is positioned above the collection point. Each tube assembly includes a valve device coupled to a top of the container, and a linear tube extending from the top into the interior of the container. Each tube assembly includes a vented foot and a flexible section connecting the linear tube to the vented foot. The container may be constructed as a bottle having an upper ring and a lower ring attached thereto. The container may be configured for pneumatic or reciprocating mixing via the first tube assembly and second tube assembly.

12 Claims, 5 Drawing Sheets

(56) References Cited

U.S. PATENT DOCUMENTS

| | | | | | |
|---|---|---|---|---|---|
| 3,752,362 | A * | 8/1973 | Risener | B67D 1/0829 | 222/85 |
| 4,470,526 | A | 9/1984 | Cha et al. | | |
| 4,828,131 | A | 5/1989 | Strubel | | |
| 5,511,692 | A * | 4/1996 | Willingham | B67D 7/0294 | 141/351 |
| 5,941,635 | A | 8/1999 | Stewart | | |
| 6,047,846 | A * | 4/2000 | Watson | B65D 1/16 | 220/601 |
| 6,357,494 | B1 * | 3/2002 | Hahn | B67D 7/344 | 141/378 |
| 10,099,912 | B2 * | 10/2018 | You | F17D 1/08 | |
| 10,105,662 | B1 * | 10/2018 | Mattson | B01F 27/2121 | |
| 2003/0089744 | A1 * | 5/2003 | Mandile | B67D 1/08 | 222/464.7 |
| 2015/0345709 | A1 * | 12/2015 | You | F17D 1/08 | 137/577 |

* cited by examiner

CONTAINER WITH BOTH DISPENSATION AND FILL DEDICATED VALVED TUBE ASSEMBLIES

This application claims priority to U.S. Provisional Patent Application No. 63/194,490 filed on May 28, 2021, the entire contents of which is incorporated by reference herein.

TECHNICAL FIELD

The present disclosure relates to containers for storing and transporting liquids.

BACKGROUND

Containers are available having top openings, sometimes called bungs, for filling and dispensation. In typical containers, a dispensation tube assembly is used for pumping a contained liquid from the interior. Typically, filling is accomplished through a simple top opening.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

A container, according to at least one embodiment, includes: a first tube assembly for dispensation of liquid from the container; and a second tube assembly for filling the container.

The container may further include: a base having a sloped floor with a collection point defining the lowest point in the interior of the container, and the first tube assembly may be positioned above the collection point.

Each tube assembly may include a valve device coupled to a top of the container, and a linear tube extending from the top into the interior of the container.

Each tube assembly may further include a vented foot and a flexible section connecting the linear tube to the vented foot.

The container may be constructed as a bottle having an upper ring and a lower ring attached thereto.

The container may be configured for pneumatic or reciprocating mixing via the first tube assembly and second tube assembly.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
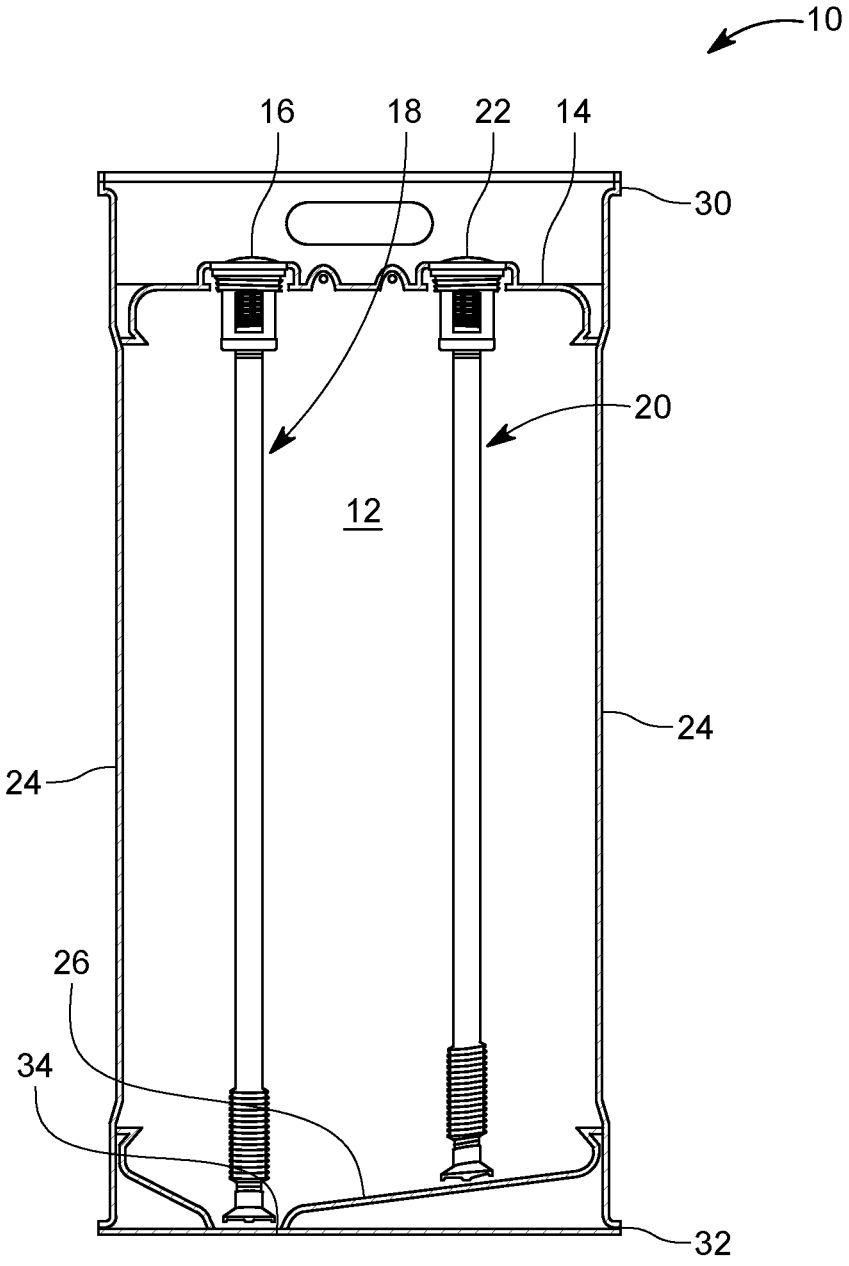
FIG. 1 is cross-sectional view of an improved container having both dispensation and fill dedicated valved tube assemblies.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

The described improved container is advantageous for better control of filling operations. Typically, only a dispensation tube assembly was used but was not implemented or oriented on the fill side of container. The unorthodox use and installation of the second tube assembly into the fill bung is novel and non-obvious. Drums are designed to contain liquids, which are often hazardous or regulated, but are common with agricultural, petroleum and specialty chemical industries. Drums come standard with two or more bungs (termed as openings in the following descriptions). A fill bung (termed as the second opening 22) is specifically designed for filling the drum with liquid, and dispense/extract bung (termed as the first opening 16) is specifically designed to remove the liquid.

Figure 2:
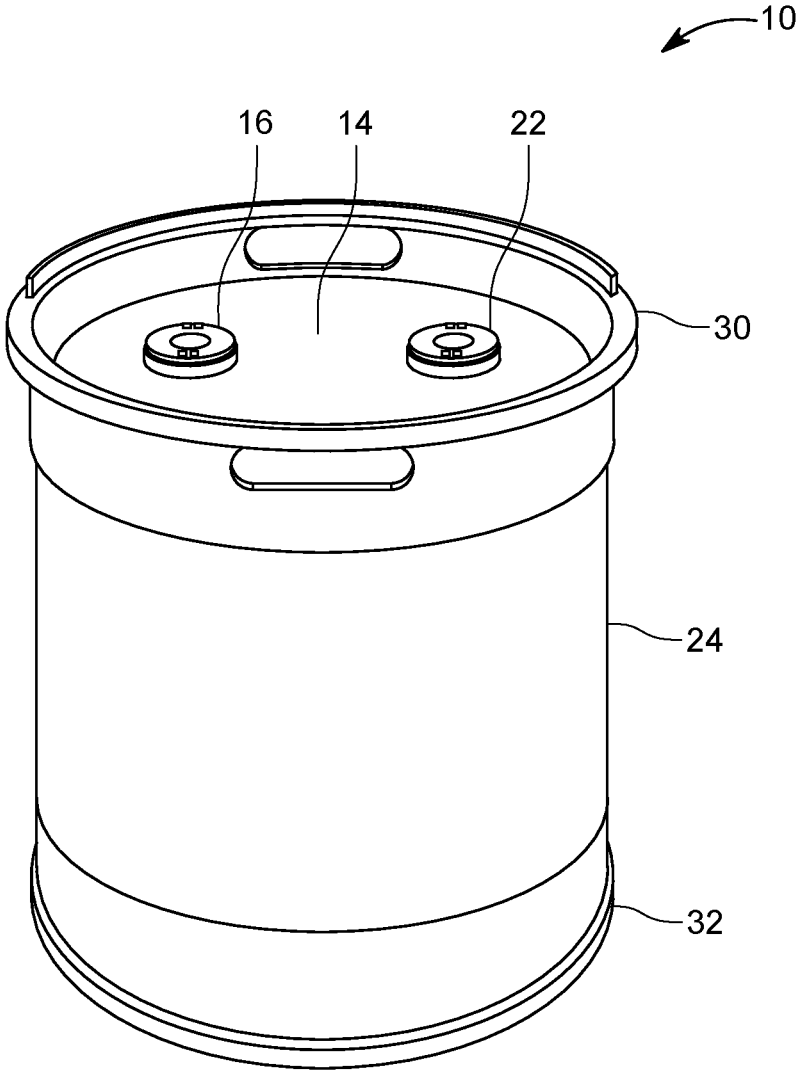
FIG. 2 is a perspective view of the exterior of the container of FIG. 1.
Figure 3:
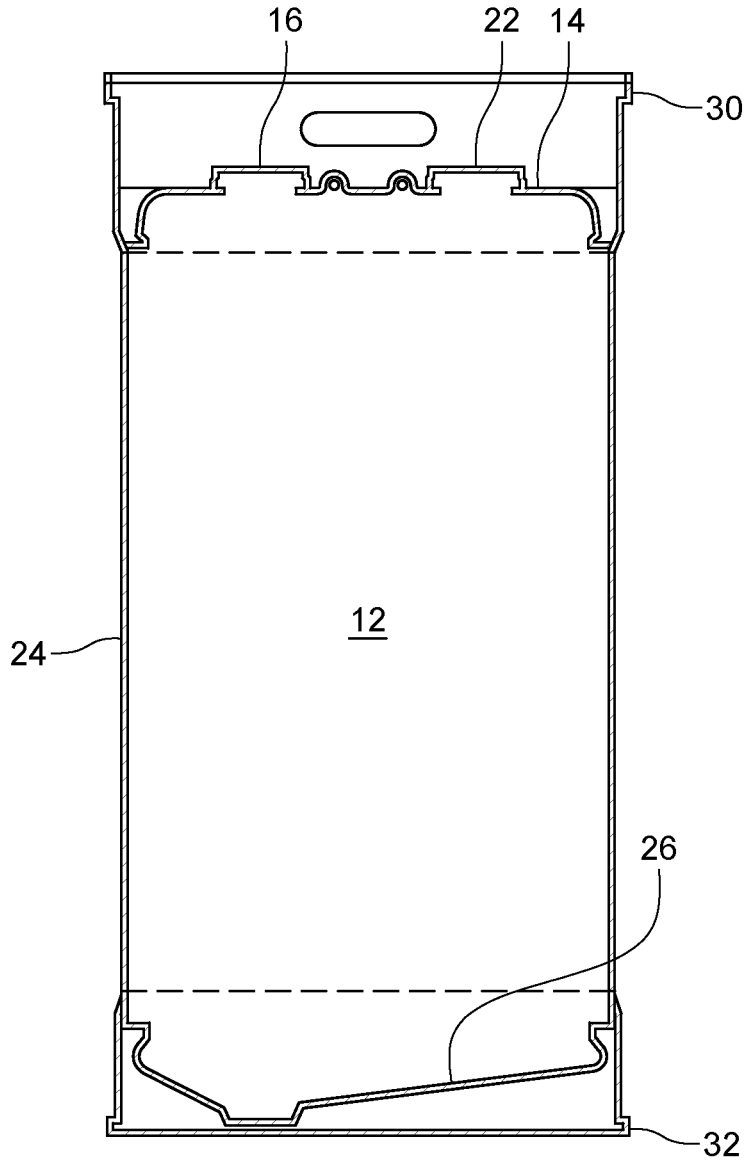
FIG. 3 is a cross-sectional view of the container without either tube assembly.
Figure 4:
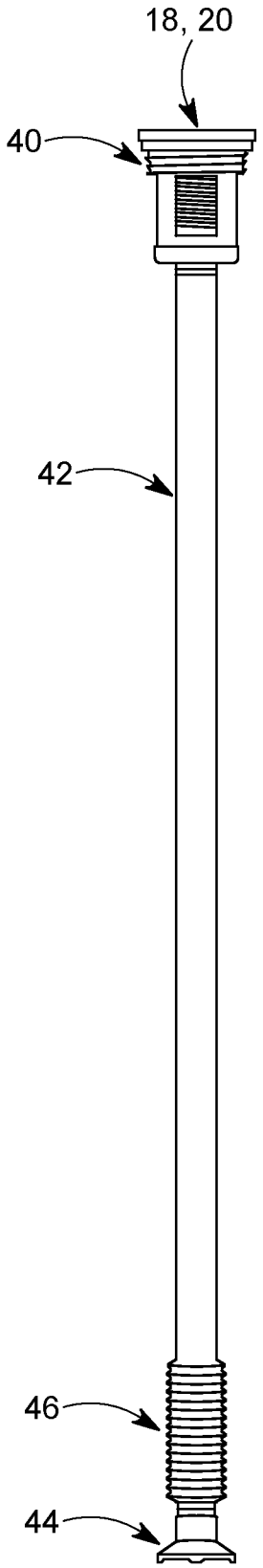
FIG. 4 is an elevation view of either valved tube assembly of FIG. 1.

An improved container 10 having both dispensation and fill dedicated valved tube assemblies is shown in cross-sectional view in FIG. 1. The exterior of the container 10 is shown in FIG. 2 for reference. The inventive aspects of the container 10 are better appreciated considering the interior 12, in which the two valved tube assemblies are shown as vertically suspended from the top 14 of the container 10. In particular, the top 14 of the container 10 has a first opening 16, for dispensation purposes, to which the upper end of a first valved tube assembly 18 is coupled. As a particularly inventive and advantageous feature of the improved container 10, the upper end of a second valved tube assembly 20, for fill purposes, is coupled to the second opening 22 of the top 14 of the container. The container 10 is illustrated as having a generally cylindrical vertical outer wall 24, which has an upper end and a lower end sealed by the top 14 and base 26 respectively.

The descriptions relate to various types of containers, including kegs, barrels, totes, and others. In some examples, the top 14 and base 26 are integral parts of the wall 24 in a bottle type of construction as in the drawings. In other examples, the top 14 may be a lid installed atop a container. An upper ring 30 and lower ring 32 are shown to stabilize the container 10 for stacking and transporting.

The container 10 is asymmetrical at its lower end with specifically isolated/independent functions for each opening. In the illustrated example, the base 26 has a generally sloped floor with a collection point 34 (FIG. 1) defining the lowest point in the interior of the container 10, thus defining the first valved tube assembly 18 as that preferably dedicated for dispensation. The corresponding first opening 16 of the top 14 is positioned above the lowest point to support the first valve assembly 18 accordingly for dispensation of final amounts of liquid contents of the container 10. In other examples of containers, the base thereof may be flat. Furthermore, the container can have two openings as shown in the illustrated example, or more openings. Other openings can also be utilized for anything from probes for chemical reading, additional venting, product addition and/or mixing, etc.

A typical container, prior to the improved container 10 of the drawings, had a dispensation dedicated valved tube assembly above the collection point. The typical container, however, had only an opening for filling of the container, with no valved tube assembly dedicated for filling. The improved container 10, however, has the second valved tube assembly 20 dedicated for filling.

Figure 5:
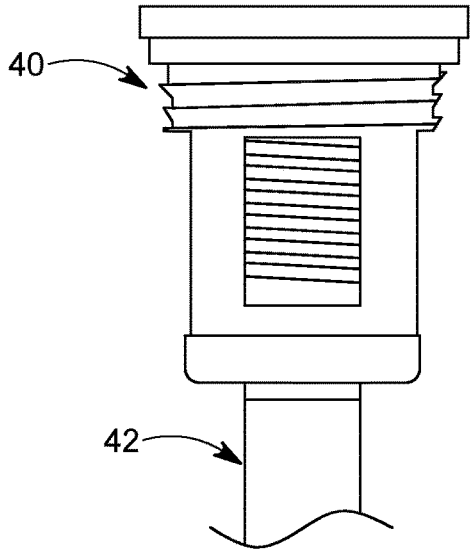
FIG. 5 is a magnified view of an upper valve device of the tube assembly of FIG. 4.
Figure 6:
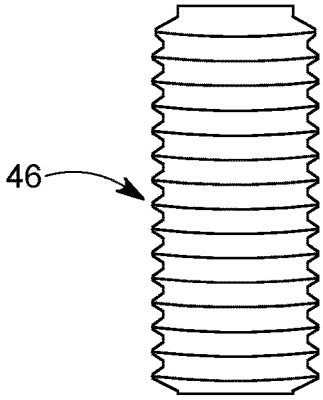
FIG. 6 is a magnified view of a flexible section of the tube assembly of FIG. 4.
Figure 7:
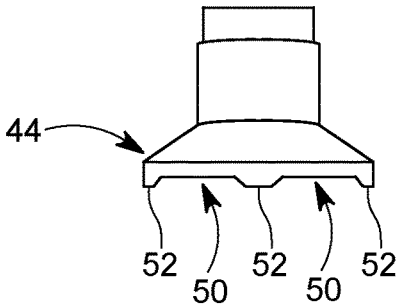
FIG. 7 is a magnified view of a lower foot of the tube assembly of FIG. 4.

The valved tube assemblies 18 and 20 are similarly constructed, such that the following descriptions apply to both the first and second valved tube assemblies. In the illustrated embodiment, the valved tube assembly (18, 20) has an upper valve device 40 (FIG. 5) for coupling to, for example, the first or second opening of the top 14 of the container 10. The valve device 40 is spring-loaded, maintaining a seal until actuated. The upper terminal end of the valve device 40 is threaded to engage threads in either opening, thereby securely mounting the valved tube assembly (18, 20) to the top 14. A linear tube 42 extends downward from the valve device toward a lower foot 44 (FIG. 7). The foot 44 is vented to prevent an unwanted seal with the floor of the container 10. Vents 50 are defined between prongs 52 (FIG. 7) to permit flow through the vents 50 even when the prongs contact the base.

A flexible section 46 is illustrated intermediate the linear tube 42 and foot 44 of the tube assembly. The flexible section 46 permits compression to maintain the foot in engagement with the floor of the container 10, whether used with the dispensation dedicated tube assembly 18 above the lowest point 34 or with the fill dedicated tube assembly 20 above a sloped portion of the floor (see FIG. 1). The flexible section 46 also permits the foot to vary its angle relative to the tube 42 to engage the sloped portion of the floor as in the second valve tube assembly 20.

In conventional industrial terminology: the container 10 may be called a drum, keg, or tote for example for beer storage and shipping; the walled and sealed portion of the container 10 may be called the bottle; the first opening 16 is called a dispense or extract bung; and the second opening 22 is called a fill bung.

The improved container 10 described above may become a model for improved compliance standards for container and shipping industries. The improved container is also advantageous for alternate mixing technology, such as reciprocating and pneumatic chemical mixing via the two valved tube assemblies, and, UN/DOT certified closure for hazardous chemical transportation.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A liquid stowage and dispensing system, comprising:

a rigid container having a base, a sidewall, and a top;

a first tube assembly for dispensation of liquid from the container, wherein the first tube assembly extends the length of the container downwardly from the top of the container to the base; and a second tube assembly for filling the container, wherein the second tube assembly extends the length of the container downwardly from the top of the container to the base, wherein the base defines a sloped interior bottom and the first tube assembly extends into a lowest most portion of the sloped interior bottom;

wherein each tube assembly comprises a valve device positioned at the top, a linear tube extending from the valve device toward the base, a flexible section at a distal end of the linear tube, and a vented foot coupled to the flexible section, the vented foot being positioned at the base; and wherein each tube assembly is fully enclosed within the container between the valve device and the vented foot.

2. The stowage and dispensing system of claim 1, wherein the lowest most portion of the sloped interior bottom defines a collection point for dispensing of fluids through the first tube assembly.

3. The stowage and dispensing system of claim 1, wherein the container is constructed as a bottle having an upper ring and lower ring attached thereto.

4. The stowage and dispensing system of claim 1, configured for pneumatic or reciprocating mixing via the first tube assembly and second tube assembly.

5. The stowage and dispensing system of claim 1, wherein the top further comprises having at least two openings to which the first tube assembly and second tube assembly are respectively coupled.

6. The stowage and dispensing system of claim 5, the top having additional openings.

7. The stowage and dispensing system of claim 1, wherein the first tube assembly is longer than the second tube assembly.

8. The stowage and dispensing system of claim 1, wherein the top of the container defines a removable lid assembly.

9. The stowage and dispensing system of claim 8, wherein the removable lid assembly allows removal of the lid assembly, where translation of the lid assembly away from the container also translates the first tube assembly and the second tube assembly.

10. The stowage and dispensing system of claim 1, wherein each of the first tube assembly and the second tube assembly define a flow actuation valve positioned proximal the top, the flow actuation valve being configured for providing selective actuation of flow through the tube assemblies.

11. The stowage and dispensing system of claim 1, wherein each of the first tube assembly and the second tube assembly defines a threaded exterior portion that is configured for being threadably received within the top of the container.

12. The stowage and dispensing system of claim 1, wherein each of the first tube assembly and the second tube assembly defines vents between prongs to permit flow through the vents even when the prongs contact the base.

* * * * *